US005689975A

United States Patent [19]

Oakey et al.

[11] Patent Number: 5,689,975

[45] Date of Patent: Nov. 25, 1997

[54] AIR SEPARATION

[75] Inventors: John Douglas Oakey, Godalming; Paul Higginbotham, Guildford, both of England

[73] Assignee: The BOC Group plc, Windlesham, England

[21] Appl. No.: 728,517

[22] Filed: Oct. 9, 1996

[30] Foreign Application Priority Data

Oct. 11, 1995 [GB] United Kingdom ..... 95020812
Sep. 9, 1996 [GB] United Kingdom ..... 9618789

[51] Int. Cl.[6] ..... F25J 3/00

[52] U.S. Cl. ..... 62/653; 62/654; 62/924

[58] Field of Search ..... 62/653, 654, 924

[56] References Cited

U.S. PATENT DOCUMENTS 5,341,647 8/1994 Koeberle et al. ..... 62/654
5,428,962 7/1995 Rieth ..... 62/653
5,471,842 12/1995 Mostello et al. ..... 62/653

*Primary Examiner*—Ronald C. Capossela
*Attorney, Agent, or Firm*—David M. Rosenblum; Salvatore P. Pace

[57] ABSTRACT

A stream of precooled and purified air is introduced into a double rectification column comprising a higher pressure rectification column and a lower pressure rectification column and is separated therein into an oxygen-rich fraction and a nitrogen-rich fraction. A stream of argon-enriched oxygen vapor flows from an outlet of the lower pressure rectification column into a side column in which argon is separated therefrom. An oxygen-enriched liquid air stream is taken from an outlet at the bottom of the higher pressure rectification column. A vaporous oxygen-enriched air stream is introduced into the lower pressure rectification column through an inlet above the outlet. At least part of the oxygen-enriched liquid is separated in a further or intermediate pressure rectification column provided with a reboiler, thereby forming a vapor depleted of oxygen and a liquid air stream further enriched in oxygen. At least one stream of the further-enriched liquid is vaporised to form the oxygen-enriched vapor that is introduced into the lower pressure rectification column. A part of the oxygen-depleted vapor is condensed in a condenser and is taken as product or reintroduced into the lower pressure rectification column. The partial reboiling in the reboiler is effected by indirect heat exchange with a vapor stream withdrawn from an intermediate region of the side column. The condenser is cooled by a stream of liquid withdrawn from the further rectification column.

12 Claims, 3 Drawing Sheets

AIR SEPARATION

BACKGROUND OF THE INVENTION

This invention relates to a process and plant for separating air.

The most important method commercially for separating air is by rectification. In such a method there are typically performed steps of compressing and purifying the air, fractionating the compressed, purified, air in the higher pressure column of a double rectification column, condensing nitrogen vapour separated in the higher pressure rectification column, employing a first stream of resulting condensate as reflux in the higher pressure rectification column, and a second stream of the resulting condensate as reflux in the lower pressure rectification column, withdrawing an oxygen-enriched liquid air stream from the higher pressure rectification column, introducing an oxygen-enriched vaporous air stream into the lower pressure rectification column, and separating the oxygen-enriched vaporous air stream therein into oxygen-rich and nitrogen-rich fractions. The condensation of nitrogen is effected by indirect heat exchange with boiling oxygen-rich liquid fraction in the bottom of the lower pressure rectification column.

The purification of the air is performed so as to remove impurities of relatively low volatility, particularly water vapour and carbon dioxide. If desired, hydrocarbons may also be removed.

At least a part of the oxygen-enriched liquid air which is withdrawn from the higher pressure rectification column is typically partially or completely vaporised so as to form the vaporous oxygen-enriched air stream which is introduced into the lower pressure rectification column.

A local maximum concentration of argon is created at an intermediate level of the lower pressure rectification column beneath the level at which the vaporous oxygen-enriched air stream is introduced. If it is desired to produce an argon product, a stream of argon-enriched oxygen vapour is taken from a vicinity of the lower pressure rectification column below the oxygen-enriched vaporous air inlet where argon concentration is typically in the range of 5 to 15% by volume, and is introduced into a bottom region of the side rectification column in which an argon product is separated therefrom. The side column has a condenser at its head from which a reflux flow for the side column can be taken. The condenser is cooled by a part or all of the oxygen-enriched liquid air withdrawn from the higher pressure rectification column, the oxygen-enriched liquid air thereby being vaporised. Such a process is illustrated in EP-A-377 117.

The rectification columns are sometimes required to separate a second liquid feed air stream in addition to the first vaporous feed air stream. Such a second liquid air stream is used when an oxygen product is withdrawn from a lower pressure rectification column in liquid state, is pressurised, and is vaporised by heat exchange with incoming air so as to form an elevated pressure oxygen product in gaseous state. A liquid air feed is also typically employed in the event that one or both the oxygen and nitrogen products of the lower pressure rectification column are taken at least in part in liquid state. Employing a liquid air feed stream tends to reduce the amount of liquid nitrogen reflux available to the rectification particularly if a liquid nitrogen product is taken. The relative amount of liquid nitrogen reflux available may also be reduced by introducing vaporous air feed into the lower pressure rectification column or by withdrawing a gaseous nitrogen product from the higher pressure rectification column, not only when liquid products are produced but also when all the oxygen and nitrogen products are withdrawn in gaseous state from the rectification columns. If an argon product is produced there is typically a need for enhanced reflux in the lower pressure rectification column in order to achieve a high argon recovery. There may therefore be a difficulty in obtaining a high argon recovery in any of the circumstances outlined above. Accordingly, it may be necessary, for example, to sacrifice either production of liquid products (including liquid product streams that are vaporised downstream of their exit from the rectification columns) or recovery of argon.

SUMMARY OF THE INVENTION

It is an aim of the present invention to provide a process and plant enables the aforesaid problem to be ameliorated.

According to the present invention there is provided an air separation process comprising separating in a double rectification column, comprising a higher pressure rectification column and a lower pressure rectification column, a flow of compressed vaporous air into an oxygen-rich fraction and a nitrogen-rich fraction, and separating in a side rectification column an argon fraction from an argon-enriched oxygen vapour stream withdrawn from an intermediate outlet of the lower pressure rectification column, wherein an oxygen-rich liquid air stream is taken from the higher pressure rectification column, a vaporous oxygen-enriched air stream is introduced into the lower pressure rectification column through an inlet above the said intermediate outlet. At least part of said oxygen-enriched liquid air stream is separated in an intermediate pressure rectification column at a pressure between the pressure at the bottom of the higher pressure rectification column and that at the said inlet to the lower pressure rectification column thereby forming a liquid air stream further enriched in oxygen and a vapour depleted of oxygen, at least one stream of the further-enriched liquid is vaporised so as to form part or all of the said vaporous oxygen-enriched air stream, a flow of the oxygen-depleted vapour is condensed, at least part of the condensed oxygen-depleted vapour is introduced into the lower pressure rectification column and/or is taken as product, the intermediate pressure rectification column is reboiled by a stream of vapour withdrawn either from a section of the lower pressure rectification column extending from said intermediate outlet to said inlet or from the side rectification column, and a liquid stream of a mixture comprising oxygen and nitrogen and is withdrawn from an intermediate mass exchange region of the intermediate pressure rectification column and is employed in condensing the flow of oxygen-depleted vapour.

The invention also provides an air separation plant comprising a double rectification column, comprising a higher pressure rectification column and a lower pressure rectification column for separating a flow of compressed vaporous air into an oxygen-rich fraction and a nitrogen-rich fraction, and a side rectification column for separating an argon-enriched vapour stream withdrawn from an intermediate outlet of the lower pressure rectification column, wherein the higher pressure rectification column has an outlet for an oxygen-enriched liquid air stream and the lower pressure rectification column has a first inlet for an oxygen-enriched vaporous air stream above said intermediate outlet. The plant additionally includes an intermediate pressure rectification column for separating at least part of said oxygen-enriched liquid air stream at a pressure between the pressure at the bottom of the higher pressure rectification column and that at the said inlet to the lower pressure rectification column, whereby, in use, a liquid air stream further enriched in oxygen and a vapour depleted of oxygen are formed; a heat exchanger for vaporising a stream of the further enriched liquid air so as to form a part or all of the vaporous oxygen-enriched air feed to the lower pressure rectification column, a condenser for condensing a flow of the oxygen-depleted vapour having an outlet for condensate communicating with a further inlet to the lower pressure rectification column and/or with a product collection vessel; and a reboiler associated with the intermediate pressure rectification column having condensing passages communicating with an outlet from a section of the lower pressure rectification column extending from said intermediate outlet to said first inlet, or with an outlet from the side rectification column; and the condenser has boiling passages therein communicating at their inlet end with an intermediate mass exchange region of the intermediate pressure rectification column.

The process and plant according to the invention make it possible in comparison with a comparable conventional process and plant to reduce the total power consumption, to increase the argon yield, and to increase the yield of oxygen-rich fraction. In addition, if liquid products are produced, the ratio of liquid oxygen and/or liquid nitrogen product collected from the process to the total production of oxygen product may be increased. A part of this advantage derives from the fact that the operation of the condenser associated with the intermediate pressure rectification column makes available condensed oxygen-depleted vapour for use as reflux in the lower pressure rectification column or as product.

By employing in the process and plant according to the invention a stream from an intermediate mass exchange region of the intermediate pressure column preferably containing from 15 to 30% by volume of oxygen, and more preferably from 18 to 24% by volume of oxygen, to condense the flow of oxygen-depleted vapour, a lower temperature may be achieved in the condenser associated with the head of the intermediate pressure rectification column. As a result, the intermediate pressure rectification column may be operated at a lower pressure than if liquid from the bottom of the intermediate pressure rectification column were used to effect condensation of the oxygen-depleted vapour, and hence reboiling of the liquid at the bottom of the intermediate pressure rectification column takes place at a reduced pressure. As a result of this effect, the further-enriched liquid withdrawn from the bottom of the intermediate pressure rectification column can be formed relatively rich in oxygen. As a further result the "pinch" at the inlet to the lower pressure rectification column for vaporised further-enriched liquid is at a higher oxygen concentration than the equivalent point in a conventional process. Accordingly, the liquid-vapour ratio in the section of the lower pressure rectification column immediately above the intermediate outlet from the lower pressure rectification column from which the feed to the side column is withdrawn can be made greater than in the conventional process. Therefore, the feed rate to the side column can be increased. It is thus possible to reduce the concentration of argon in the vapour feed to the side column (in comparison with the comparable conventional process) without reducing argon recovery. A consequence of this is that the lower pressure rectification column needs less reboil to achieve a given argon recovery. Thus, for example, the rate of production or the purity of a liquid oxygen product from the lower pressure rectification column or the rate of production of a gaseous nitrogen product from the higher pressure rectification column may be enhanced. In another example, the rate of production and purity of the oxygen product or products may be maintained, but the rate at which vaporous air is fed from an expansion turbine into the lower pressure rectification column may be enhanced, thereby making possible an overall reduction in the power consumed.

As a consequence of reducing the temperature at which the liquid at the bottom of the intermediate pressure rectification column boils, a relatively low temperature stream can be used to effect this reboiling. It is therefore preferred to employ a vapour stream taken from typically 5 to 10 theoretical stages from the bottom of the side column to effect the reboiling. As a result, the side column may be arranged to operate at a lower reflux ratio above the location from which the stream for reboiling the intermediate pressure rectification column is taken. (More theoretical trays are thus required in the side column than would otherwise be necessary. However, in comparison with a comparable conventional plant, if random or structured packings are employed to effect liquid-vapour contact in the side column, the overall amount of packing required is not substantially increased, since the diameter of the side column may be reduced.) As a further result, a greater rate of condensation within the reboiler associated with the bottom of the intermediate pressure rectification column can be achieved. This has the effect, therefore, of increasing the load on the intermediate pressure rectification column and thereby enables yet further enhancement in, for example, the liquid nitrogen production or argon recovery.

The term "rectification column", as used herein, means a distillation or fractionation column, zone or zones, wherein liquid and vapour phases are countercurrently contacted to effect separation of a fluid mixture, as for example, by contacting the vapour and liquid phases on packing elements or a series of vertically spaced trays or plates mounted within the column, zone or zones. A rectification column may comprise a plurality of zones in separate vessels so as to avoid having a single vessel of undue height. For example, it is known to use a height of packing amounting to 200 theoretical plates in an argon rectification column. If all this packing were housed in a single vessel, the vessel may typically have a height of over 50 meters. It is therefore obviously desirable to construct the argon rectification column in two separate vessels so as to avoid having to employ a single, exceptionally tall, vessel.

Downstream of being employed to condense the flow of oxygen-depleted vapour, the liquid stream, now at least partially vaporised, is preferably introduced into the lower pressure rectification column.

The vapour stream which is employed to reboil the intermediate pressure rectification column is, downstream of the reboiling, preferably returned (in condensed state) to the region from which it is taken.

The stream of the further-enriched liquid is preferably vaporised in indirect heat exchange with condensing vapour separated in the side column. By employing different streams to cool the respective condensers associated with the intermediate pressure and side rectification columns optimisation of the operation of these condensers is facilitated.

A flow of liquid air may be introduced into any or all of the higher pressure, lower pressure and intermediate pressure rectification columns. A stream of liquid air is preferably introduced into the intermediate pressure rectification column at the same level as that from which the stream is taken for use in condensing vapour separated in the intermediate pressure rectification column. The stream of liquid air may, if desired, be taken from the higher pressure rectification column. Such introduction of liquid air may be used to control the concentration of the oxygen in the further-enriched liquid so as to ensure that if it is used to cool the condenser associated with the side column, an adequate temperature difference can be maintained therein so as to effect the condensation.

Any conventional refrigeration system may be employed to meet the refrigeration requirements of the process and plant according to the invention. Typically, the process and plant according to the invention utilise a refrigeration system comprising two expansion turbines in parallel with one another. Typically, one of the turbines is a warm turbine, that is to say its inlet temperature is approximately ambient temperature or a little therebelow, say, down to –30° C. and its outlet temperature is in the range of 130 to 180 K, and the other turbine is a cold turbine whose inlet temperature typically also in the range of 130 to 180 K and whose outlet temperature is typically the saturation temperature of the exiting gas or a temperature not more than 5 K above such saturation temperature.

Preferably, both turbines expand air. The cold turbine preferably has an outlet communicating with a bottom region of the higher pressure rectification column. The warm turbine typically recycles air in heat exchange with streams being cooled to a compressor of incoming air. In another alternative the warm turbine has an outlet communicating with the bottom region of the higher pressure rectification column.

The reboiler associated with the intermediate pressure rectification column may simply partially reboil just the oxygen-enriched liquid stream upstream of its introduction into that column, or may partially reboil a mixture of the oxygen-enriched liquid with a liquid flow from a lowermost liquid-vapour contact device in that column.

The vaporous air feed to the higher pressure rectification column is preferably taken from a source of compressed air which has been purified by extraction therefrom, of water vapour, carbon dioxide, and, if desired, hydrocarbons and which has been cooled in indirect heat exchange with products of the air separation. Any liquefied air feed to the higher pressure rectification column is preferably formed in an analogous manner.

BRIEF DESCRIPTION OF THE DRAWINGS

The process and plant according to the present invention will now be described by way of example with reference to the accompanying drawings, in which.

The drawings are not to scale.

DETAILED DESCRIPTION

Figure 1:
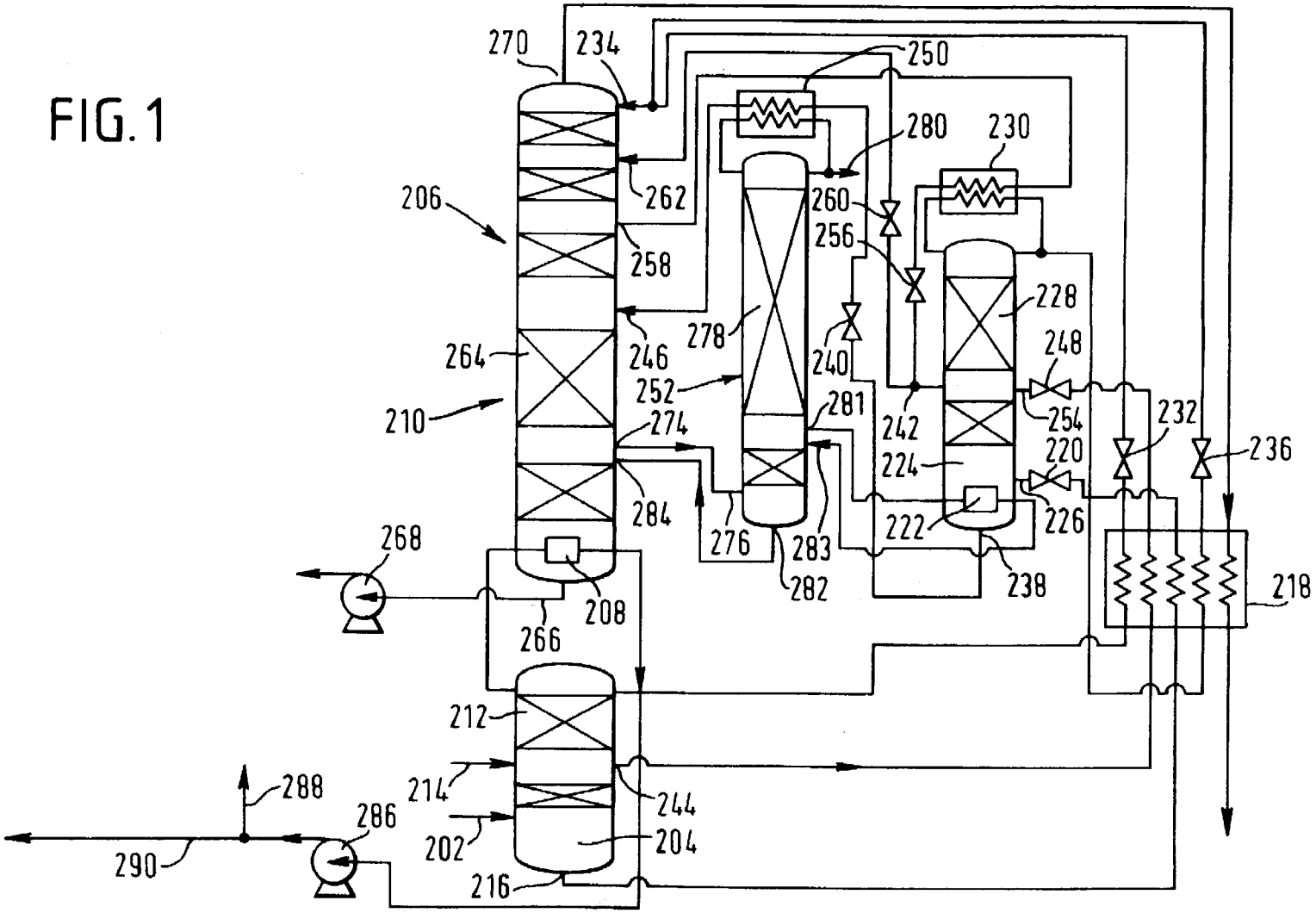
FIG. 1 is a schematic flow diagram of an arrangement of rectification columns forming part of an air separation plant.

Referring to FIG. 1 of the drawings, a first stream of vaporous air is introduced through an inlet 202 into a bottom region of a higher pressure rectification column 204, the top of which is thermally linked by a condenser-reboiler 208 to the bottom region of a lower pressure rectification column 206. Together, the higher pressure rectification column 204, the lower pressure rectification column 206 and the condenser-reboiler 208 constitute double rectification column 210. The higher pressure rectification column 204 contains liquid-vapour contact devices 212 in the form of plates, trays or packings. The devices 212 enable an ascending vapour phase to come into intimate contact with a descending liquid phase such that mass transfer takes place between the two phases. Thus, the ascending vapour is progressively enriched in nitrogen, the most volatile of the three main components (nitrogen, oxygen and argon) of the purified air; the descending liquid is progressively enriched in oxygen, the least volatile of these three components.

A second compressed, purified, air stream is introduced into the higher pressure rectification column 204 in liquid state through an inlet 214 which is typically located at a level such that the number of trays or plates or the height of packing therebelow corresponds to a few theoretical trays (for example, about 5).

A sufficient height of packing or a sufficient number of trays or plates is included in the higher pressure rectification column 204 that an essentially pure nitrogen vapour flows out of the top of the column 204 into the condenser-reboiler 208 where it is condensed. A part of the resulting condensate is returned to the higher pressure rectification column 204 as reflux. An oxygen-enriched liquid is withdrawn from the bottom of the higher pressure rectification column 204 through an outlet 216. The oxygen-enriched liquid air stream is sub-cooled by passage through a heat exchanger 218. The sub-cooled oxygen-enriched, liquid air stream is reduced in pressure by passage through a throttling valve 220. The resulting fluid stream flows into the sump of an intermediate pressure rectification column 224 through an inlet 226. The intermediate rectification column has a reboiler 222 in its sump and includes liquid-vapour contact devices 228 that cause intimate contact between an ascending vapour phase and a descending liquid phase with the result that mass transfer takes place between the two phases.

A sufficient height of packing or number of trays or plates is generally included in the intermediate pressure rectification column 224 for the vapour at the top of the column to be essentially pure nitrogen. This vapour flows into a condenser 230 where it is condensed. A part of the condensate is employed as reflux in the intermediate pressure rectification column 224. Another part of the condensate is employed to provide liquid nitrogen reflux for the lower pressure rectification column 206. The condenser-reboiler 208 is also so employed. A stream of the condensate formed in the condenser-reboiler 208 is sub-cooled by passage through the heat exchanger 218, is reduced in pressure by passage through a throttling valve 232, and is introduced into the top of the lower pressure rectification column 206 through an inlet 234. A stream of nitrogen condensate is taken from the condenser 230, is sub-cooled by passage through the heat exchanger 218, and is reduced in pressure by passage through a throttling valve 236. The resulting pressure-reduced liquid nitrogen is mixed with that introduced into the lower pressure column 206 through the inlet 234, the mixing taking place downstream of the throttling valve 232.

The reboiler 222 forms an ascending vapour stream in operation of the intermediate pressure rectification column 224. The reboiler 222 has the effect of further enriching in oxygen the liquid in the sump of the intermediate pressure rectification column 224 by reboiling a part of that liquid. A stream of the further enriched liquid is withdrawn from the intermediate pressure rectification column 224 through an outlet 238. The further-enriched liquid stream flows through a throttling valve 240. The resulting liquid stream passes through a condenser 250 which is associated with the top of a side column 252 in which an argon-oxygen stream withdrawn from the lower pressure rectification column 206 is separated. (The concentration of argon in the argon-oxygen stream is greater than the normal concentration of argon in air.) The stream of further-enriched liquid is at least partially vaporised in the condenser 250. The resulting stream is introduced into the lower pressure rectification column 206 through an inlet 246.

A stream in liquid state comprising oxygen and nitrogen is withdrawn from the intermediate pressure rectification column 224 through an outlet 242. This stream typically has essentially the same composition as liquid air. A stream of similar composition is withdrawn through an outlet 244 from the same level of the higher pressure rectification column 204 as that at which the inlet 214 is located, and is passed through the heat exchanger 218, thus being sub-cooled. The resulting sub-cooled liquid air stream flows through a throttling valve 248, thereby being reduced in pressure, and is introduced into the intermediate pressure rectification column 224 through an inlet 254 which is at the same level as the outlet 242. The stream withdrawn from the column 224 through the outlet 242 is divided into two subsidiary streams. One of the subsidiary streams flows through a pressure reducing valve 256 and is employed to provide refrigeration to the condenser 230, thus effecting condensation of nitrogen vapour therein. As a result, the subsidiary stream of liquid air is at least partially reboiled. The resulting fluid flows from the condenser 230 and is introduced into the lower pressure rectification column 206 through an inlet 258 located at a level of the lower pressure rectification column 206 above that of the inlet 246 but below that of the inlet 234. The second subsidiary stream flows through a pressure reducing valve 260 and is introduced into the lower pressure rectification column 206 through an inlet 262 which is at a level of the column 206 above that of the inlet 258 but below that of the inlet 234.

The various streams containing oxygen and nitrogen that are introduced into the lower pressure rectification column 206 are separated therein to form, in its sump, oxygen, preferably containing less than 0.5% by volume of impurities, (more preferably less than 0.1% of impurities) and a nitrogen product at its top containing less than 0.1% by volume of impurities. The separation is effected by contact of an ascending vapour phase with descending liquid on liquid-vapour contact devices 264, which are preferably packing (typically structured packing), but which alternatively can be provided by trays or plates. The ascending vapour is created by boiling liquid oxygen in the boiling passages of the reboiler-condenser 208 in indirect heat exchange with condensing nitrogen. An oxygen product in liquid state is withdrawn from the bottom of the rectification column through an outlet 266 by a pump 268. Additionally, an oxygen product may be withdrawn in vapour state through another outlet (not shown). A gaseous nitrogen product is withdrawn from the top of the rectification column 206 through an outlet 270 and is passed through the heat exchanger 218 in countercurrent heat exchange with the streams being sub-cooled.

A local maximum of argon is created in a section of the lower pressure rectification column 206 extending from an intermediate outlet 274 to the intermediate inlet 246. An argon-enriched vapour stream is withdrawn through the outlet 274 and is fed into the bottom of the side rectification column 252 through an inlet 276. An argon product is separated from the argon-enriched oxygen vapour stream, which stream typically contains from 6 to 14% by volume of argon, in the side column 252. The column 252 contains liquid-vapour contact devices 278 in order to effect intimate contact, and hence mass transfer, between ascending vapour and descending liquid. The descending liquid is created by operation of the condenser 250 to condense argon taken from the top of the column 252. A part of the condensate is returned to the top of the column 252 as reflux; another part is withdrawn through an outlet 280 as liquid argon product. If the argon product contains more than 1% by volume of oxygen, the liquid-vapour contact devices 278 may comprise structured or random packing, typically a low pressure drop structured packing, or trays or plates in order to effect the separation. If, however, the argon is required to have a lower concentration of oxygen, low pressure drop packing is usually employed so as to ensure that the pressure at the top of the side column 252 is such that the condensing temperature of the argon exceeds the temperature of the fluid which is used to cool the condenser 250.

A stream of vaporous mixture of argon and oxygen is withdrawn through an outlet 281 from a level of the side rectification column 252 from 5 to 10 theoretical stages above the bottom thereof and is used to heat the reboiler 222 associated with the intermediate pressure rectification column 224. The stream of the vaporous mixture is condensed in part or entirely, and is returned to the column 252 through an inlet 283.

An impure liquid oxygen stream is withdrawn from the bottom of the side rectification column 252 through an outlet 282 and is passed through an inlet 284 to the same region of the low pressure rectification column 206 as that from which the argon-enriched oxygen vapour stream is withdrawn through the outlet 274.

If desired, an elevated pressure nitrogen product may be taken from the nitrogen condensed in the reboiler-condenser 208 by means of a pump 286. A part of the elevated pressure liquid nitrogen stream may be taken from a pipe 288 and vaporised, typically in indirect heat exchange with incoming air streams. Another party of the elevated pressure liquid nitrogen stream may be taken via a conduit 290 as a liquid nitrogen product. Similarly, an elevated pressure oxygen gaseous product may be created by vaporisation of part of the liquid oxygen stream withdrawn by the pump 268. The remaining part of the oxygen may be taken as a liquid product.

If desired, some or all of each of the streams that is reduced in pressure by passage through a valve may be sub-cooled upstream of the valve.

In a typical example of the operation of the part of the plant shown in FIG. 1, the lower pressure rectification column 206 operates at a pressure about 1.4 bar at its top; the higher pressure rectification column 204 operates at a pressure about 5.5 bar at its top; the side rectification column 252 operates at a pressure of 1.3 bar at its top; and the intermediate pressure rectification column 224 operates at a pressure of approximately 2.7 bar at its top.

Figure 2:
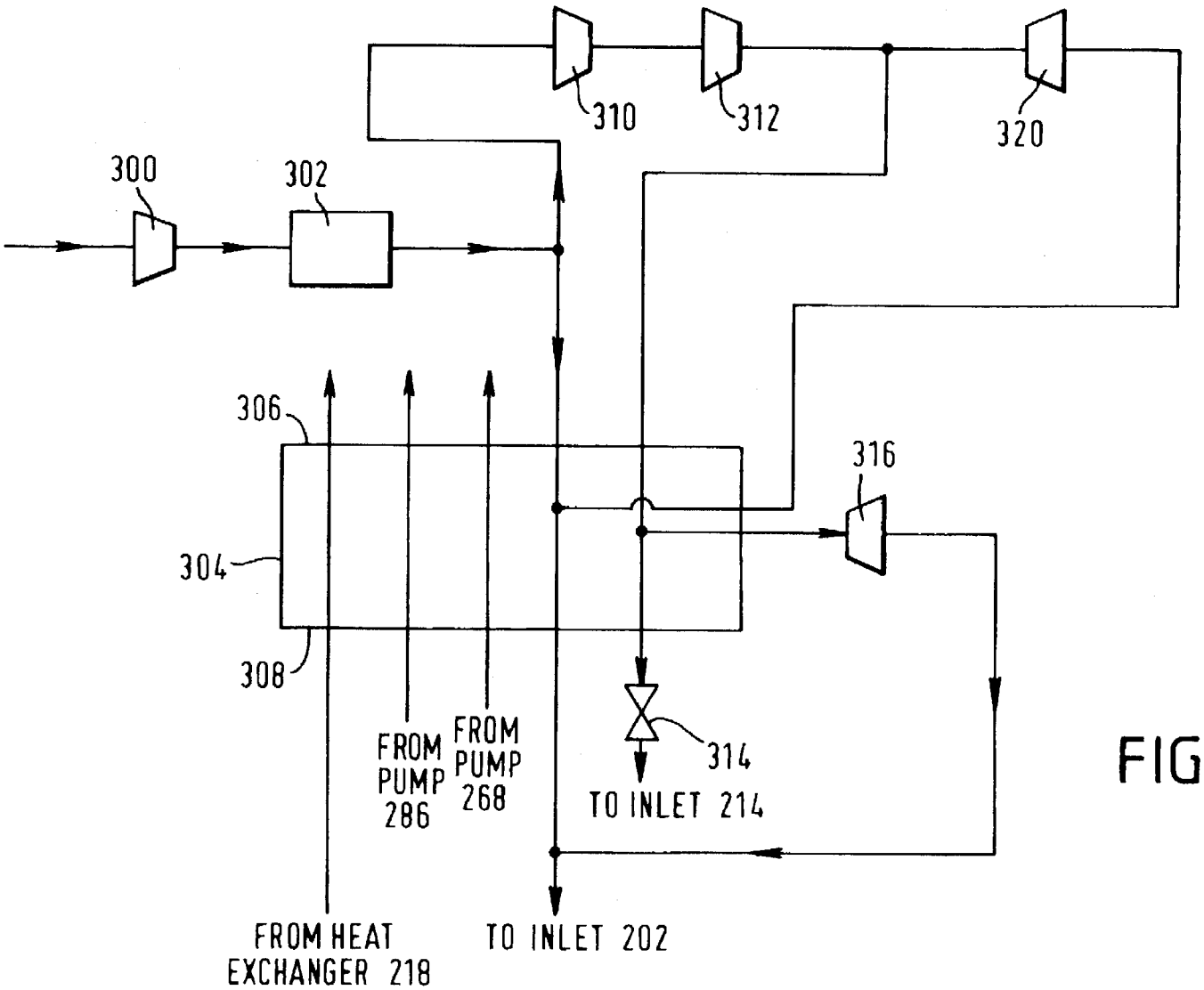
FIG. 2 is a schematic flow diagram of a heat exchanger and associated apparatus for producing the feed streams to that part of the air separation plant which is shown in FIG. 1.

Referring now to FIG. 2 of the accompanying drawings, there is shown another part of the air separation plant which is employed to form the air streams employed in that part of the plant shown in FIG. 1. Referring to FIG. 2, an air stream is compressed in a first compressor 300. The compressor 300 has an aftercooler (not shown) associated therewith so as to remove the heat of compression from the compressed air. Downstream of the compressor 300, the air stream is passed through a purification unit 302 effective to remove water vapour and carbon dioxide therefrom. The unit 302 employs beds (not shown) of adsorbent to effect this removal of water vapour and carbon dioxide. If desired, hydrocarbons may also be removed in the unit 302. The beds of the unit 302 are operated out of sequence with one another such that while one or more beds are purifying the compressed air stream, the remainder are able to be regenerated, for example, by being purged by a stream of hot nitrogen. Such purification units and their operation are well known and need not be described further.

The purified air stream is divided into two subsidiary streams. A first subsidiary stream of purified air flows through a main heat exchanger 304 from its warm end 306 to its cold end 308 and is cooled to approximately its dew point. The resulting cooled vaporous air stream forms a part of the air stream which is introduced into the higher pressure rectification column 204 through the inlet 202 in that part of the plant which is shown in FIG. 1.

Referring again to FIG. 2, the second subsidiary stream of purified compressed air is further compressed in a first booster-compressor 310 having an aftercooler (not shown) associated therewith to remove the heat of compression. The further compressed air stream is compressed yet again in a second booster-compressor 312. It is again cooled in an aftercooler (not shown) to remove heat of compression. Downstream of this aftercooler, one part of the yet further compressed air is passed into the main heat exchanger 304 from its warm end 306. The air flows through the main heat exchanger and is withdrawn from its cold end 308. This air stream is, downstream of the cold end 308, passed through a throttling or pressure reduction valve 314 and exits the valve 314 predominantly in liquid state. This liquid air stream forms the liquid stream which is introduced into the higher pressure rectification column 204 through the inlet 214 (see FIG. 1).

A first expansion turbine 316 is fed with a stream of the yet further compressed air withdrawn from an intermediate location of the main heat exchanger 304. The air is expanded in the turbine 316 with the performance of external work and the resulting air leaves the turbine 316 at approximate its saturation temperature and at the same pressure as that at which the first subsidiary air stream leaves the cold end of the main heat exchanger 304. The air from the expansion turbine 316 is mixed with the first subsidiary stream downstream of the cold end 308 of the main heat exchanger 304. A further part of the yet further compressed air is taken from upstream of the warm end 306 of the main heat exchanger 304 and is expanded with the performance of external work in a second expansion turbine 320. The air leaves the turbine 320 at a pressure approximately equal to that at the bottom of the higher pressure rectification column 204 and a temperature in the range of 130 to 180 K. This air stream is introduced into the first subsidiary stream of air as it passes through the main heat exchanger 304.

A part of each of the liquid oxygen and liquid nitrogen streams pressurised respectively by the pumps 268 and 286 flows through the main heat exchanger 304 countercurrently to the air streams and is vaporised by indirect heat exchange therewith. In addition, the gaseous nitrogen product stream is taken from the heat exchanger 218 (see FIG. 1) and is warmed to ambient temperature by passage through the heat exchanger 304. The pressure of the air stream that is liquefied and the pressures of the liquid nitrogen and the liquid oxygen streams are selected so as to maintain thermodynamically efficient operation of the heat exchanger 304.

Figure 3:
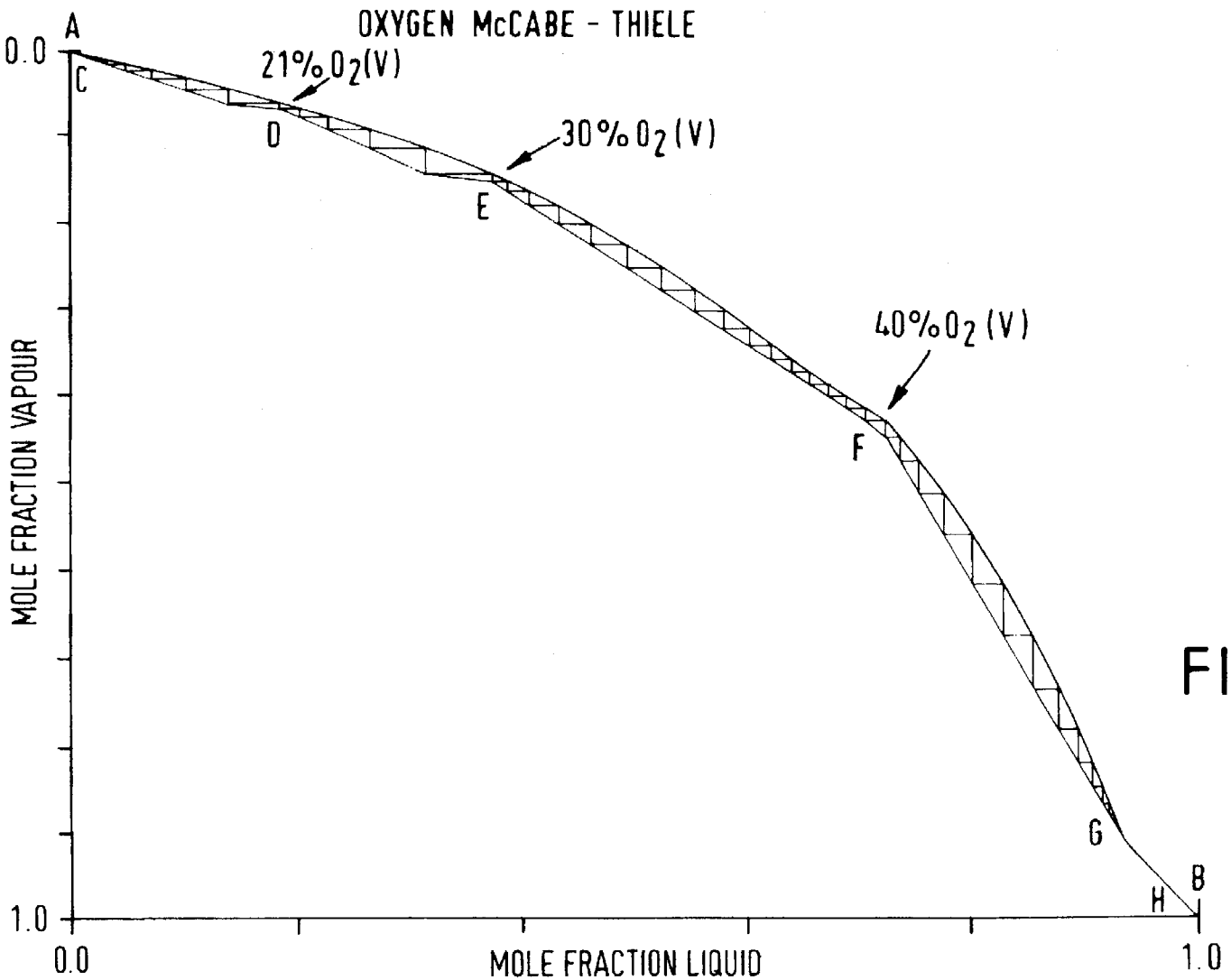
FIG. 3 is a schematic McCabe-Thiele diagram illustrating operation of the lower pressure rectification column shown in FIG. 1 in one example of a process according to the invention.

FIG. 3 illustrates the operation of the lower pressure rectification column 206 shown in FIG. 1. The curve AB is the equilibrium line for operation of the lower pressure rectification column 206. The curve CDEFGH is its operating line. Point D is at the liquid air inlet 262; point E is at the inlet 258 for vaporised air; and point F is at the inlet 246 for vaporised further enriched liquid. It can be seen from FIG. 3 that the mole fraction of oxygen in the vapour at point F is in the range of 0.4 to 0.5. Thus the slope of the operating line below the point F is relatively high and hence there is a relatively large liquid/vapour ratio below the point F in the section of the lower pressure rectification column that extends down to the location from which the feed to the argon column is taken. As a result, operation of the section FG of the lower pressure rectification column is improved in the manner explained above. It can further be seen that the section EF of the operating line is relatively close to minimum reflux. At the same time, At the same time, operation of the condenser associated with the top of the intermediate rectification column increases the amount of liquid nitrogen that is made. As a result, increased recovery of liquid nitrogen product is possible. For example, in the process according to EP-A-0 733 869, 5,000 $Nm^3$/hr of liquid nitrogen can be produced with an oxygen production of 22,000 $Nm^3$/hr and an argon recovery of 94.8%. In accordance with an example of the process according to the invention, the liquid nitrogen production can be increased to approximately 7,500 $Nm^3$/hr with the same argon recovery.

We claim:

1. An air separation process comprising:

separating in a double rectification column, comprising a higher pressure rectification column and a lower pressure rectification column, a flow of compressed vaporous air into an oxygen-rich fraction and a nitrogen-rich fraction;

separating in a side rectification column an argon fraction from an argon-enriched oxygen vapour stream withdrawn from an intermediate outlet of the lower pressure rectification column;

taking an oxygen-rich liquid air stream from the higher pressure rectification column;

introducing a vaporous oxygen-enriched air stream is introduced into the lower pressure rectification column through an inlet above the said intermediate outlet;

separating at least part of said oxygen-enriched liquid air stream is separated in an intermediate pressure rectification column at a pressure between the pressure at the bottom of the higher pressure rectification column and that at the said inlet to the lower pressure rectification column to form a liquid air stream further enriched in oxygen and a vapour depleted of oxygen;

vaporizing at least one stream of the further enriched liquid so as to form part or all of the said vaporous oxygen-enriched air stream;

condensing a flow of the oxygen-depleted vapour;

introducing at least part of the condensed oxygen-depleted vapour into the lower pressure rectification column;

reboiling the intermediate pressure rectification column by a stream of vapour withdrawn either from a section of the lower pressure rectification column extending from said intermediate outlet to said inlet or from the side rectification column; and withdrawing a liquid stream of a mixture comprising oxygen and nitrogen is withdrawn from an intermediate mass exchange region of the intermediate pressure rectification column and employing said liquid stream in condensing the flow of oxygen-depleted vapour.

2. An air separation process comprising:

separating in a double rectification column, comprising a higher pressure rectification column and a lower pressure rectification column, a flow of compressed vaporous air into an oxygen-rich fraction and a nitrogen-rich fraction;

separating in a side rectification column an argon fraction from an argon-enriched oxygen vapour stream withdrawn from an intermediate outlet of the lower pressure rectification column;

taking an oxygen-rich liquid air stream from the higher pressure rectification column;

introducing a vaporous oxygen-enriched air stream is introduced into the lower pressure rectification column through an inlet above the said intermediate outlet;

separating at least part of said oxygen-enriched liquid air stream is separated in an intermediate pressure rectification column at a pressure between the pressure at the bottom of the higher pressure rectification column and that at the said inlet to the lower pressure rectification column to form a liquid air stream further enriched in oxygen and a vapour depleted of oxygen;

vaporizing at least one stream of the further enriched liquid so as to form part or all of the said vaporous oxygen-enriched air stream;

condensing a flow of the oxygen-depleted vapour;

taking at least part of the condensed oxygen-depleted vapour as a product;

reboiling the intermediate pressure rectification column by a stream of vapour withdrawn either from a section of the lower pressure rectification column extending from said intermediate outlet to said inlet or from the side rectification column; and withdrawing a liquid stream of a mixture comprising oxygen and nitrogen is withdrawn from an intermediate mass exchange region of the intermediate pressure rectification column and employing said liquid stream in condensing the flow of oxygen-depleted vapour.

3. The process as claimed in claim 1 or claim 2, in which the liquid stream of the mixture comprising oxygen and nitrogen contains from 10 to 30% by volume of oxygen.

4. The process as claimed in claim 1 or claim 2, in which the vapour stream which is employed to reboil the intermediate pressure rectification column, is downstream of the reboiling, returned (in condensed state) to the region from which it is taken.

5. The process as claimed in claim 1 or claim 2, in which the stream of the further-enriched liquid is vaporised in indirect heat exchange with condensing vapour separated in the side column.

6. The process as claimed in claim 1 or claim 2, in which a flow of liquid air is also separated in the double rectification column.

7. The process as claimed in claim 1 or claim 2, in which a stream of liquid air is introduced into the intermediate pressure rectification column at the same level as that from which the stream from the said intermediate mass exchange region is withdrawn.

8. The process as claimed in claim 6, in which the stream of liquid air that is introduced into the intermediate pressure rectification column is taken from the higher pressure rectification column.

9. The process as claimed in claim 1 or claim 2, in which the further enriched liquid contains from 40 to 50% by volume of oxygen.

10. The process as claimed in claim 1 or claim 2, in which the liquid stream of the mixture containing oxygen and nitrogen is partly or totally vaporised in condensing the oxygen-depleted vapour, and the resulting partly or totally vaporised stream is introduced into the lower pressure rectification column.

11. An air separation plant comprising:

a double rectification column, comprising a higher pressure rectification column and a lower pressure rectification column for separating a flow of compressed vaporous air into an oxygen-rich fraction and a nitrogen-rich fraction;

a side rectification column for separating an argon-enriched vapour stream withdrawn from an intermediate outlet of the lower pressure rectification column;

the higher pressure rectification column having an outlet for an oxygen-enriched liquid air stream and the lower pressure rectification column having a first inlet for an oxygen-enriched vaporous air stream above said intermediate outlet;

an intermediate pressure rectification column for separating at least part of said oxygen-enriched liquid air stream at a pressure between the pressure at the bottom of the higher pressure rectification column and that at the said inlet to the lower pressure rectification column to form a liquid air stream further enriched in oxygen and a vapour depleted of oxygen;

a heat exchanger for vaporising a stream of the further enriched liquid air so as to form a part or all of the vaporous oxygen-enriched air feed to the lower pressure rectification column;

a condenser for condensing a flow of the oxygen-depleted vapour having an outlet for condensate communicating with a further inlet to the lower pressure rectification column and/or with a product collection vessel; and a reboiler associated with the intermediate pressure rectification column having condensing passages communicating with an outlet from a section of the lower pressure rectification column extending from said intermediate outlet to said first inlet, or with an outlet from the side rectification column;

the condenser having boiling passages therein communicating at their inlet end with an intermediate mass exchange region of the intermediate pressure rectification column.

12. An air separation plant as claimed in claim 11, wherein the double rectification column has an inlet for liquid air.

* * * * *